US009968993B2

(12) United States Patent
Volks

(10) Patent No.: US 9,968,993 B2
(45) Date of Patent: May 15, 2018

(54) FEEDER SYSTEM

(71) Applicant: FOSECO INTERNATIONAL LIMITED, Derbyshire (GB)

(72) Inventor: Christof Volks, Velen (DE)

(73) Assignee: FOSECO INTERNATIONAL LIMITED, Derbyshire (GB)

( * ) Notice: Subject to any disclaimer, the term of this patent is extended or adjusted under 35 U.S.C. 154(b) by 0 days. days.

(21) Appl. No.: 15/323,609

(22) PCT Filed: Sep. 2, 2015

(86) PCT No.: PCT/GB2015/052528
§ 371 (c)(1),
(2) Date: Jan. 3, 2017

(87) PCT Pub. No.: WO2016/034872
PCT Pub. Date: Mar. 10, 2016

(65) Prior Publication Data

US 2017/0209917 A1 Jul. 27, 2017

(30) Foreign Application Priority Data

Sep. 2, 2014 (GB) ..... 1415516.2

(51) Int. Cl.
*B22C 9/08* (2006.01)
*B22C 7/00* (2006.01)
*B22C 9/02* (2006.01)

(52) U.S. Cl.
CPC ..... *B22C 9/088* (2013.01); *B22C 7/00* (2013.01); *B22C 9/02* (2013.01)

(58) Field of Classification Search
CPC ..... B22C 9/088; B22C 9/02; B22C 9/084
See application file for complete search history.

(56) References Cited

U.S. PATENT DOCUMENTS 5,915,450 A 6/1999 Aufderheide et al.
6,904,952 B2 6/2005 Skerdi et al.
(Continued)

FOREIGN PATENT DOCUMENTS

DE 2334501 3/1975
DE 295 10 068 10/1996
(Continued)

OTHER PUBLICATIONS

Search Report dated Jan. 22, 2015 in Great Britain Application No. 1415516.2, 3 pages.
(Continued)

*Primary Examiner* — Kevin P Kerns
*Assistant Examiner* — Steven S Ha
(74) *Attorney, Agent, or Firm* — Nixon & Vanderhye PC

(57) ABSTRACT

The present invention relates to a feeder system for metal casting. The feeder system comprises a feeder sleeve mounted on a tubular body. The feeder sleeve has a longitudinal axis and comprises a continuous sidewall that defines a cavity for receiving liquid metal during casting. The sidewall extends generally around the longitudinal axis and has a base adjacent the tubular body. The tubular body defines an open bore therethrough for connecting the cavity to the casting. A groove extends into the sidewall from the base to a first depth and the tubular body projects into the groove to a second depth and is held in position by retaining means. The second depth being less than the first depth so that upon application of a force in use the retaining means are overcome and the tubular body is pushed further into the groove.

17 Claims, 9 Drawing Sheets

(56) References Cited

U.S. PATENT DOCUMENTS

| | | | | |
|---|---|---|---|---|
| 2008/0230201 | A1* | 9/2008 | Skerdi | B22C 9/084 164/359 |
| 2008/0265129 | A1 | 10/2008 | Skerdi | |
| 2015/0283602 | A1 | 10/2015 | Schafer | |

FOREIGN PATENT DOCUMENTS

| | | |
|---|---|---|
| DE | 20112425 | 10/2001 |
| DE | 20 2004 021109 | 10/2006 |
| DE | 10 2007 012117 | 9/2008 |
| DE | 10 2008 009 730 | 8/2009 |
| DE | 202011050109 U1 | 9/2012 |
| DE | 20 2013 102 133 | 7/2013 |
| DE | 20 2013 001 933 | 6/2014 |
| EP | 0 265 112 | 4/1988 |
| EP | 1 184 104 | 3/2002 |
| EP | 1775045 | 4/2007 |
| GB | 1597832 | 9/1981 |
| GB | 2141649 | 1/1985 |
| WO | WO 2005/051568 | 6/2005 |
| WO | 2005/095020 | 10/2005 |
| WO | WO 2007/141446 | 12/2007 |
| WO | WO 2012/110753 | 8/2012 |
| WO | WO 2013/171439 | 11/2013 |
| WO | WO 2014/083155 | 6/2014 |

OTHER PUBLICATIONS

Search Report dated May 30, 2016 in International Application No. PCT/GB2015/052529, 11 pages.

Search Report dated Jun. 10, 2016 in International Application No. PCT/GB2015/052530, 13 pages.

U.S. Appl. No. 15/323,557, filed Jan. 3, 2017, Volks et al.

"Foseco Feedex K Sleeves Improve Productivity and Process Control," Foundry Trade Journal, vol. 179, No. 3624, May 1, 2005, pp. 99.

International Search Report for PCT/GB2015/052528, dated Dec. 7, 2015, 3 pages.

Fischer et al., "Die Entwicklung Leistungsstarker Speisungshilfsmittel zur Steigerung der Gussqualität", Giesserei, vol. 100, No. 8, Aug. 1, 2013, pp. 54-61.

Non-final Office Action dated Jan. 12, 2018 issued in U.S. Appl. No. 15/323,557 (18 pages).

* cited by examiner

FEEDER SYSTEM

This application is the U.S. national phase of International Application No. PCT/GB2015/052528 filed 2 Sep. 2015, which designated the U.S. and claims priority to GB Patent Application No. 1415516.2 filed 2 Sep. 2014, the entire contents of each of which are hereby incorporated by reference.

The present invention relates to a feeder system for use in metal casting operations utilising casting moulds, a feeder sleeve for use in the feeder system and a process for preparing a mould comprising the feeder system.

In a typical casting process, molten metal is poured into a pre-formed mould cavity which defines the shape of the casting. However, as the metal solidifies it shrinks, resulting in shrinkage cavities which in turn result in unacceptable imperfections in the final casting. This is a well known problem in the casting industry and is addressed by the use of feeder sleeves or risers which are integrated into the mould, either during mould formation by applying them to a pattern plate, or later by inserting a sleeve into a cavity in the formed mould. Each feeder sleeve provides an additional (usually enclosed) volume or cavity which is in communication with the mould cavity, so that molten metal also enters into the feeder sleeve. During solidification, molten metal within the feeder sleeve flows back into the mould cavity to compensate for the shrinkage of the casting.

After solidification of the casting and removal of the mould material, unwanted residual metal from within the feeder sleeve cavity remains attached to the casting and must be removed. In order to facilitate removal of the residual metal, the feeder sleeve cavity may be tapered towards its base (i.e. the end of the feeder sleeve which will be closest to the mould cavity) in a design commonly referred to as a neck down sleeve. When a sharp blow is applied to the residual metal it separates at the weakest point which will be near to the mould (the process commonly known as "knock off"). A small footprint on the casting is also desirable to allow the positioning of feeder sleeves in areas of the casting where access may be restricted by adjacent features.

Although feeder sleeves may be applied directly onto the surface of the casting mould cavity, they are often used in conjunction with a feeder element (also known as a breaker core). A breaker core is simply a disc of refractory material (typically a resin bonded sand core or a ceramic core or a core of feeder sleeve material) with a hole usually in its centre which sits between the mould cavity and the feeder sleeve. The diameter of the hole through the breaker core is designed to be smaller than the diameter of the interior cavity of the feeder sleeve (which need not necessarily be tapered) so that knock off occurs at the breaker core close to the casting surface.

Moulding sand can be classified into two main categories. Chemical bonded (based on either organic or inorganic binders) or clay-bonded. Chemically bonded moulding binders are typically self-hardening systems where a binder and a chemical hardener are mixed with the sand and the binder and hardener start to react immediately, but sufficiently slowly enough to allow the sand to be shaped around the pattern plate and then allowed to harden enough for removal and casting.

Clay-bonded moulding uses clay and water as the binder and can be used in the "green" or undried state and is commonly referred to as greensand. Greensand mixtures do not flow readily or move easily under compression forces alone and therefore to compact the greensand around the pattern and give the mould sufficient strength properties as detailed previously, a variety of combinations of jolting, vibrating, squeezing and ramming are applied to produce uniform strength moulds at high productivity. The sand is typically compressed (compacted) at high pressure, usually using one or more hydraulic rams.

To apply sleeves in such high pressure moulding processes, pins are usually provided on the moulding pattern plate (which defines the mould cavity) at predetermined locations as mounting points for the feeder sleeves. Once the required sleeves are placed on the pins (such that the base of the feeder is either on or raised above the pattern plate), the mould is formed by pouring moulding sand onto the pattern plate and around the feeder sleeves until the feeder sleeves are covered and the mould box is filled. The application of the moulding sand and subsequent high pressures may cause damage and breakage of the feeder sleeve, especially if the feeder sleeve is in direct contact with the pattern plate prior to ram up, and with increasing casting complexity and productivity requirements, there is a need for more dimensionally stable moulds and consequently, a tendency towards higher ramming pressures and resulting sleeve breakages.

The Applicant has developed a range of collapsible feeder elements for use in combination with feeder sleeves, which are described in WO2005/051568, WO2007141446, WO2012110753 and WO2013171439. The feeder elements compress when subjected to pressure during moulding, thereby protecting the feeder sleeve from damage.

US2008/0265129 describes a feeder insert for inserting into a casting mould used for casting metals, comprising a feeder body having a feeder cavity therein. The bottom side of the feeder body is in communication with the casting mould and the top side of the feeder body is provided with an energy absorbing device.

EP1184104A1 (Chemex GmbH) describes a two-part feeder sleeve (which can be either insulating or exothermic) which telescopes when the moulding sand is compressed; the internal wall of the second (upper) part is flush with the external wall of the first (lower) part.

EP1184104A1 FIGS. 3a to 3d illustrate the telescoping action of the two-part feeder sleeve (102). The feeder sleeve (102) is in direct contact with the pattern (122), which can be detrimental when an exothermic sleeve is employed since it can result in a poor surface finish, localised contamination of the casting surface and even sub-surface casting defects. In addition, even though the lower part (104) is tapered, there is still a wide foot-print on the pattern (122) since the lower part (104) must be relatively thick to withstand the forces experienced during ram-up. This is unsatisfactory in terms of knock-off and the space taken up by the feeder system on the pattern. The lower inner part (104) and the upper outer part (106) are held in position by retaining elements (112). The retaining elements (112) break off and fall into the moulding sand (150) to allow the telescoping action to take place. The retaining elements will build up in the moulding sand over time and thereby contaminate it. This is particularly troublesome where the retaining elements are made from exothermic material since they may react creating small explosive defects.

U.S. Pat. No. 6,904,952 (AS Luengen GmbH & Co. KG) describes a feeder system where a tubular body is temporarily glued to the inner wall of a feeder sleeve. There is relative movement between the feeder sleeve and the tubular body when the moulding sand is compressed.

Increasing demands are being placed on feeding systems for use in high pressure moulding systems, partly due to advances in moulding equipment, and partly due to new castings being produced. Certain grades of ductile iron and particular casting configurations may adversely influence the effectiveness of feed performance through the neck of certain metal feeder elements. Additionally, certain moulding lines or casting configurations may result in over compression (collapsing of the feeder element or telescoping of the feeder system) resulting in the base of the sleeve being in close proximity to the casting surface separated by only a thin layer of sand. The present invention provides a feeder system for use in metal casting and seeks to overcome one or more problems associated with prior art feeder systems or to provide a useful alternative.

According to a first aspect of the present invention there is provided a feeder system for metal casting comprising a feeder sleeve mounted on a tubular body;

the feeder sleeve having a longitudinal axis and comprising a continuous sidewall extending generally around the longitudinal axis that defines a cavity for receiving liquid metal during casting, the sidewall having a base adjacent the tubular body;

the tubular body defining an open bore therethrough for connecting the cavity to the casting, wherein a groove extends into the sidewall from the base to a first depth and the tubular body projects into the groove to a second depth and is held in position by retaining means, the second depth being less than the first depth so that upon application of a force in use the retaining means are overcome and the tubular body is pushed further into the groove.

In use the feeder system is mounted on a mould pattern, typically placed over a moulding pin attached to the pattern plate to hold the system in place, such that the tubular body is next to the mould. The open bore defined by the tubular body provides a passage from the feeder sleeve cavity to the mould cavity to feed the casting as it cools and shrinks. During moulding and subsequent ram-up, the feeder system will experience a force in the direction of the longitudinal axis of the tubular body (the bore axis). This force pushes the feeder sleeve and the tubular body together so that the retaining means are overcome and the tubular body, which already partially projects into the groove, projects even further into the groove. Hence, the high compression pressure causes relative movement between the feeder sleeve and the tubular body rather than breakage of the feeder sleeve. Typically the feeder system will experience a ram up pressure (as measured at the pattern plate) of at least 30, 60, 90, 120 or 150 $N/cm^2$.

U.S. Pat. No. 6,904,952 FIG. 2 shows a tubular body (3) glued inside the cavity of a feeder sleeve (1) by means of a hot glue seam (7). During moulding the feeder sleeve (1) separates from the tubular body (3) and is forced further onto the tubular body; the new position is illustrated by the hatching. During casting the liquid metal will be in direct contact with the tubular body rather than the feeder sleeve in the area of overlap. The tubular body will be at room temperature and may cause a chilling effect, especially when the tubular body is made from metal. The chilling effect may cause premature solidification of the liquid metal in the feeder sleeve resulting in reduced feeding and subsequent casting defects. In U.S. Pat. No. 6,904,952 the tubular body is said to be made from metals, plastics, cardboard, ceramics or similar materials with aluminium and iron sheet being preferred. In the present invention the part of the tubular body that overlaps with the feeder is within the sidewall and not in direct contact with liquid metal during casting. This not only minimises any chilling effect, but also results in superheating of the tubular body when exothermic feeders are used; both sides of the metal tubular body are in direct intimate contact with the overlapping part of the exothermic feeder, and therefore ensure the feeder metal remains liquid sufficiently long enough to feed the casting.

Tubular Body

The tubular body serves two functions: (i) the tubular body has an open bore therethrough which provides a passage from the feeder sleeve cavity to the casting mould and (ii) the relative movement of the tubular body and the feeder sleeve serves to absorb energy that could otherwise cause breakage of the feeder sleeve.

The tubular body partially (but not fully) projects into the groove so that there is further space within the groove for subsequent relative movement. In one embodiment the groove and tubular body are sized and shaped (e.g. to form a fin, rib, overlap or notch) such that the retaining means is a friction fit that holds the tubular body in position prior to ram-up (densification of the moulding sand around the feeder system to produce the mould for casting). Additionally or alternatively, the tubular body is releasably fixed to the feeder sleeve by means of adhesive; the retaining means is adhesive. In a further embodiment the feeder system (the feeder sleeve or the tubular body) comprises a retaining element (e.g. a wing, tab or biasing means) or retaining elements which releasably hold the tubular body in position at the second depth prior to ram-up.

It will be understood that the tubular body and the feeder sleeve must be capable of further relative movement during ram-up (in practice the tubular body will remain stationary and the feeder sleeve will move). Therefore the release means (e.g. friction fit, glue and/or any retaining elements) must allow the tubular body and the feeder sleeve to separate in use. For example, the retaining element could deform to allow the tubular body to move into the groove or could separate entirely from the feeder system. It is preferable for the retaining elements to remain part of the feeder system rather than separating off since pieces would end up in the moulding sand or, even worse, in the casting itself.

In one embodiment the retaining means comprise the tubular body having at least one retaining element. Additionally or alternatively, the retaining means comprise the feeder sleeve having at least one retaining element.

In one embodiment the retaining element(s) deform(s) on ram-up.

In one embodiment the retaining element comprises biasing means (e.g. a spring) that holds the tubular body in place within the groove. The biasing means are overcome on ram-up allowing the tubular body to move further into the groove. If the groove is defined by parallel walls, then the biasing means will not deform on ram-up.

In one embodiment the tubular body comprises at least one projection which abuts the feeder sleeve (e.g. the base of the sidewall or within the groove). In one such embodiment the tubular body comprises from 2 to 8 or from 3 to 6 projections.

In one embodiment the tubular body comprises at least one outward projection. An outward projection extends away from the bore axis. In one such embodiment, the outward projection is a fin. A fin may be employed to provide a friction fit between the tubular body and the feeder sleeve and will not deform on ram-up.

In one embodiment the tubular body comprises at least one inward projection. An inward projection extends towards the bore axis. In one such embodiment the tubular body is folded inwards or "crimped" to form an overlap, which does not deform on overlap. An outward projection can be preferable to an inward projection if there is a risk that an inward projection could break off and fall into the casting.

In one embodiment the retaining element (e.g. projection) is an integral retaining element i.e. the tubular body and the retaining element(s) are of uniform construction. In one embodiment the integral projection is formed by folding a portion of the tubular body (inwardly or outwardly) to form a tab or wing. The portion of the tubular body may comprise an edge of the tubular body or may be spaced from an edge of the tubular body. In another embodiment the integral projection is formed as a notch or bulge in the tubular body (away from the peripheral edge). In another embodiment the integral projection is a rib which extends around the entire periphery of the tubular body. The rib can grip the feeder sleeve within the groove.

The size and mass of the tubular body will depend on the application. It is generally preferable to reduce the mass of the tubular body when possible. This reduces material costs and can also be beneficial during casting, e.g. by reducing the heat capacity of the tubular body. In one embodiment the tubular body has a mass of less than 50, 40, 30, 25 or 20 g.

It will be understood that the tubular body has a longitudinal axis, the bore axis. In general the feeder sleeve and the tubular body will be shaped such that the bore axis and the feeder sleeve longitudinal axis are the same. However, this is not essential.

The height of the tubular body may be measured in a direction parallel to the bore axis and may be compared to depth of the groove (the first depth). In some embodiments the ratio of the height of the tubular body to the first depth is from 1:1 to 5:1, from 1.1:1 to 3:1 or from 1.3:1 to 2:1.

The tubular body has an inner diameter and an outer diameter and a thickness which is the difference between the inner and outer diameters (all measured in a plane perpendicular to the bore axis). The thickness of the tubular body must be such that it allows the tubular body to project into the groove. In some embodiments the thickness of the tubular body is at least 0.1, 0.3, 0.5, 0.8, 1, 2 or 3 mm. In some embodiments the thickness of the tubular body is no more than 5, 3, 2, 1.5, 1, 0.8 or 0.5 mm. In one embodiment the tubular body has a thickness of from 0.3 to 1.5 mm. A small thickness is beneficial for a number of reasons including: reducing the material required to manufacture the tubular body and allowing the corresponding groove in the sidewall to be narrow, and reducing the heat capacity of the tubular body and hence the amount of energy absorbed from the feeder on casting. The groove extends from the base of the sidewall and the wider the groove, the wider the base must be to accommodate it.

In one embodiment the tubular body has a circular cross-section. However, the cross-section could be non-circular e.g. oval, obround or elliptical. In one preferred embodiment the tubular body narrows (tapers) in a direction away from the feeder sleeve (next to the casting in use). A narrow portion adjacent the casting is known as a feeder neck and provides better knock off of the feeder. In one series of embodiments, the angle of the tapered neck relative to the bore axis shall be no more than 55, 50, 45, 40 or 35°.

To further improve knock off, the base of the tubular body may have an inwardly directed lip to provide a surface for mounting on the mould pattern and produce a notch in the resulting cast feeder neck to facilitate its removal (knock off).

The tubular body can be manufactured from a variety of suitable materials including metal (e.g. steel, iron, aluminium, aluminium alloys, brass, copper etc.) or plastics. In a particular embodiment, the tubular body is made from metal. A metal tubular body can be made to have a small thickness whilst retaining sufficient strength to withstand moulding pressures. In one embodiment the tubular body is not manufactured from feeder sleeve material (whether insulating or exothermic). Feeder sleeve material is not generally strong enough to withstand moulding pressures at small thickness, whereas a thicker tubular body requires a wider groove in the sidewall and therefore increases the size (and associated cost) of the feeder system as a whole. Additionally, a tubular body comprising feeder sleeve material may also cause poor surface finish and defects where it is in contact with the casting.

In certain embodiments where the tubular body is formed from metal, it may be press-formed from a single metal piece of constant thickness. In one embodiment the tubular body is manufactured via a drawing process, whereby a metal sheet blank is radially drawn into a forming die by the mechanical action of a punch. The process is considered deep drawing when the depth of the drawn part exceeds its diameter and is achieved by redrawing the part through a series of dies. In another embodiment, the tubular body is manufactured via a metal spinning or spin forming process, whereby a blank disc or tube of metal is first mounted on a spinning lathe and rotated at high speed. Localised pressure is then applied in a series of roller or tool passes that causes the metal to flow down onto and around a mandrel that has the internal dimensional profile of the required finished part.

To be suitable for press-forming or spin-forming, the metal should be sufficiently malleable to prevent tearing or cracking during the forming process. In certain embodiments the feeder element is manufactured from cold-rolled steels, with typical carbon contents ranging from a minimum of 0.02% (Grade DC06, European Standard EN10130—1999) to a maximum of 0.12% (Grade DC01, European Standard EN10130—1999). In one embodiment the tubular body is made from steel having a carbon content of less than 0.05, 0.04 or 0.03%.

Feeder Sleeve

The groove has a first depth (D1), which is the distance by which the groove extends away from the base into the sidewall. Typically, the groove has a uniform depth i.e. the distance from the base into the sidewall is the same no matter where it is measured. However, a groove of variable depth could be employed if desired and the first depth will be understood to be the minimum depth, since this dictates the extent to which the tubular body can project into the groove.

Before ram-up, the tubular body is received in the groove to a second depth (D2) i.e. D2<D1 so the tubular body partially projects into the groove. After ram-up, the tubular body projects further into the groove to a third depth (D3), possibly even to the full depth of the groove.

The groove must be capable of receiving the tubular body. Hence the cross-section of the groove (in a plane perpendicular to the bore axis) corresponds to the cross-section of the tubular body e.g. the groove is a circular groove and the tubular body has a circular cross-section. It will be understood that the groove is a single, continuous groove and this is necessary to put the invention into effect. Relative movement between a feeder sleeve and a tubular body could be achieved by a feeder sleeve having a series of slots if the tubular body had a corresponding shape e.g. a castellated edge. However, such a combination is outside the scope of the present invention and would not be practical since the system is not closed; there is a risk that moulding sand would penetrate into the feeder sleeve through gaps in the edge of tubular body.

In one series of embodiments the groove has a first depth (D1) of at least 20, 30, 40 or 50 mm. In one series of embodiments the first depth (D1) is no more than 100, 80, 60 or 40 mm. In one embodiment the first depth (D1) is from 25 to 50 mm. The first depth (D1) can be compared to the height of the feeder sleeve. In one embodiment, the first depth corresponds to from 10 to 50% or 20 to 40% of the height of the feeder sleeve.

The groove is considered to have a maximum width (W), which is measured in a direction approximately perpendicular to the bore axis and/or the feeder sleeve axis. It will be understood that the width of the groove must be sufficient to allow the tubular body to be received inside the groove. In one series of embodiments the groove has a maximum width of at least 0.5, 1, 2, 3, 5 or 8 mm. In one series of embodiments the groove has a maximum width of no more than 10, 5, 3 or 1.5 mm. In one embodiment the groove has a maximum width of from 1 to 3 mm.

The maximum width of the groove can be compared to the thickness of the tubular body. It will be understood that the thickness of the tubular body must be the same as or less than the maximum width of the groove. If the tubular body and groove have similar sizes then a direct friction fit may be possible. If the tubular body is much thinner than the groove then a further retaining element is likely to be required. In one series of embodiments the thickness of the tubular body is at least 30%, 40%, 50%, 60%, 70%, 80% or 90% of the maximum width of the groove. In another series of embodiments the thickness of the tubular body is no more than 95%, 80%, 70%, 60% or 50% of the maximum width of the groove.

The groove may have a uniform width i.e. the width of the groove is the same no matter where it is measured. Alternatively, the groove may have a non-uniform width. For example, the groove may taper away from the base of the sidewall. Hence, the maximum width is measured at the base of the sidewall and the width then reduces to a minimum value at the first depth (D1). This may be used in certain embodiments to control and reduce the amount that the tubular body projects into the sleeve on ram up.

In one series of embodiments the second depth (D2, the depth to which the tubular body is received in the groove) is at least 10, 15, 20, 25, 30, 40 or 50% of the first depth. In one series of embodiments the second depth is no more than 90, 80, 70, 60, 50, 40, 30, 20 or 10% of the first depth. In one embodiment the second depth is from 10 to 30% of the first depth.

Typically, the tubular body projects into the groove to a uniform depth i.e. the distance from the base to the end of tubular body is the same no matter where it is measured. However, a tubular body having an uneven edge (e.g. a castellated edge) could be employed if desired such that the distance would vary and the second depth will be understood to be the maximum depth, save that there can be no gap between the tubular body and the base of the sidewall to avoid ingress of moulding sand into the casting.

The groove in the sidewall is separate from the feeder sleeve cavity. In one embodiment the groove is located at least 5, 8 or 10 mm from the feeder sleeve cavity.

The nature of the feeder sleeve material is not particularly limited and it may be for example insulating, exothermic or a combination of both. Neither is its mode of manufacture particularly limited, it may be manufactured for example using either the vacuum-forming process or core-shot method. Typically a feeder sleeve is made from a mixture of low and high density refractory fillers (e.g. silica sand, olivine, alumino-silicate hollow microspheres and fibres, chamotte, alumina, pumice, perlite, vermiculite) and binders. An exothermic sleeve further requires a fuel (usually aluminium or aluminium alloy), an oxidant (typically iron oxide, manganese dioxide, or potassium nitrate) and usually initiators/sensitisers (typically cryolite).

In one embodiment a conventional feeder sleeve is manufactured and then feeder sleeve material is removed from the base to form the groove e.g. by drilling or grinding. In another embodiment the feeder sleeve is manufactured with the groove in place, typically by a core-shooting method incorporating a tool that defines the groove e.g. the tool has a thin mandrel around which the sleeve is formed, after which the sleeve is removed (stripped) from the tool and mandrel. In this embodiment it is preferable to use a tapered mandrel to make it easier to strip the formed sleeve, thus giving a tapered groove in the base of the sleeve.

In one series of embodiments the feeder sleeve has a strength (crush strength) of at least 5 kN, 8 kN, 12 kN, 15 kN, 20 kN or 25 kN. In one series of embodiments, the sleeve strength is less than 25 kN, 20 kN, 18 kN, 15 kN, 10 kN or 8 kN. For ease of comparison the strength of a feeder sleeve is defined as the compressive strength of a 50×50 mm cylindrical test body made from the feeder sleeve material. A 201/70 EM compressive testing machine (Form & Test Seidner, Germany) is used and operated in accordance with the manufacturer's instructions. The test body is placed centrally on the lower of the steel plates and loaded to destruction as the lower plate is moved towards the upper plate at a rate of 20 mm/minute. The effective strength of the feeder sleeve will not only be dependent upon the exact composition, binder used and manufacturing method, but also on the size and design of the sleeve, which is illustrated by the fact that the strength of a test body is usually higher than that measured for a standard flat topped sleeve.

In one embodiment the feeder sleeve comprises a roof spaced from the base of the sidewall. The sidewall and roof together define the cavity for receiving liquid metal during casting. In one such embodiment the roof and the sidewall are integrally formed. Alternatively, the sidewall and the roof are separable i.e. the roof is a lid. In one embodiment both the sidewall and the roof are made from feeder sleeve material. Feeder sleeves are available in a number of shapes including cylinders, ovals and domes. As such, the sidewall may be parallel to or angled from the feeder sleeve longitudinal axis. The roof (if present) may be flat topped, domed, flat topped dome, or any other suitable shape.

The roof of the sleeve may be closed so that the feeder sleeve cavity is enclosed, and it may also contain a recess (a blind bore) extending partially through the top section of the feeder (opposite the base) to assist in mounting the feeder system on a moulding pin attached to the mould pattern. Alternatively, the feeder sleeve may have an aperture (an open bore) that extends through the whole of the feeder roof so that the feeder cavity is open. The aperture must be wide enough to accommodate a support pin but narrow enough to avoid sand entering the feeder sleeve cavity during moulding. The diameter of the aperture may be compared to the maximum diameter of the feeder sleeve cavity (both measured in a plane perpendicular to the longitudinal axis of the feeder sleeve). In one embodiment the diameter of the aperture is no more than 40, 30, 20, 15 or 10% of the maximum diameter of the feeder sleeve cavity.

In use, the feeder system is typically placed on a support pin to hold the feeder system in the required position on the mould pattern plate prior to the sand being compressed and rammed up. On ram up, the sleeve moves towards the mould pattern surface and the pin, if fixed, may puncture the roof of the feeder sleeve, or it simply may traverse through the aperture or recess as the sleeve moves downwards. This movement and contact of the roof with the pin may cause small fragments of sleeve to break off and fall into the casting cavity, resulting in poor casting surface finish or localised contamination of the casting surface. This may be overcome by lining the aperture or recess in the roof with a hollow insert or internal collar, which may be manufactured from a variety of suitable materials including metal, plastic or ceramic. Thus, in one embodiment, the feeder sleeve may be modified to include an internal collar lining the aperture or recess in the roof of the feeder. This collar may be inserted into the aperture or recess in the sleeve roof after the sleeve has been produced, or alternatively, is incorporated during manufacture of the sleeve, whereby sleeve material is core-shot or moulded around the collar, after which the sleeve is cured and holds the collar in place. Such a collar protects the sleeve from any damage that might be caused by the support pin during moulding and ram up.

The invention also resides in a feeder sleeve for use in the feeder system according to embodiments of the first aspect.

According to a second aspect of the present invention there is provided a feeder sleeve for use in metal casting, the feeder sleeve having a longitudinal axis and comprising a continuous sidewall extending generally around the longitudinal axis and a roof extending generally across the longitudinal axis, the sidewall and roof together defining a cavity for receiving liquid metal during casting, wherein the sidewall has a base spaced from the roof and a groove extends from the base into the sidewall.

The comments above in relation to the first aspect also apply to the second aspect with the exception that the feeder sleeve of the second aspect must comprise a roof. It will be understood that that the groove extends away from the base and towards the roof.

In one embodiment the groove has a uniform width. Alternatively the groove has a non-uniform width. In one such embodiment the groove tapers away from the base of the sidewall. The use of a tapering groove can be useful in certain embodiments. For example, a tapered groove can induce deformation of a retaining element.

In one embodiment an aperture (an open bore) extends through the feeder roof. In one such embodiment an internal collar lines the aperture. This embodiment is useful when the feeder sleeve is employed with a support pin as described above.

In one embodiment the roof is closed i.e. no aperture extends through the feeder roof.

According to a third aspect of the present invention there is provided a process for preparing a mould comprising placing the feeder system of the first aspect on a pattern, the feeder system comprising a feeder sleeve mounted on a tubular body;

the feeder sleeve comprising a continuous sidewall that defines a cavity for receiving liquid metal during casting, the sidewall having a base adjacent the tubular body;

the tubular body defining an open bore therethrough for connecting the cavity to the casting, wherein a groove extends into the sidewall from the base to a first depth and the tubular body projects into the groove to a second depth and is held in position by retaining means, the second depth being less than the first depth;

surrounding the pattern with mould material;

compacting the mould material; and removing the pattern from the compacted mould material to form the mould;

wherein compacting the mould material comprises applying pressure to the feeder system such that the retaining means are overcome and the tubular body is pushed further into the groove to a third depth.

The mould could be a horizontally parted or a vertically parted mould. If used in a vertically parted moulding machine (such as Disamatic flaskless moulding machines manufactured by DISA Industries A/S) the feeder system is typically placed on the swing (pattern) plate when in the horizontal position during the normal mould making cycle. The sleeves may be placed on the horizontal pattern or swing plate manually or automatically by the use of robots.

The comments above in relation to the first and second aspects also apply to the third aspect.

In one series of embodiments the retaining means are overcome such that the tubular body is pushed further into the groove to a third depth (D3), the third depth being at least 50, 60, 70, 80 or 90% of the first depth. In one series of embodiments the third depth is no more than 95, 90, 80 or 70% of the first depth. In a particular embodiment the third depth is from 60 to 80% of the first depth.

In one embodiment the retaining means comprises the tubular body having at least one retaining element that deforms to allow the tubular body to move further into the groove (but does not separate from the tubular body). In one such embodiment the retaining element is an integral retaining element. In one embodiment the retaining element is an outwardly projecting tab or notch.

In one embodiment the retaining means are overcome without deformation of the tubular body or the feeder sleeve. In one such embodiment the retaining means comprise a friction fit between the tubular body and the groove. For example, the use of biasing means within a groove of uniform width.

In one series of embodiments compacting the mould material comprises applying a ram up pressure (as measured at the pattern plate) of at least 30, 60, 90, 120 or 150 N/cm$^2$.

In one embodiment the mould material is clay bonded sand (usually referred to as greensand), which typically comprises a mixture of clay such as sodium or calcium bentonite, water and other additives such as coal dust and cereal binder. Alternatively the mould material is mould sand containing a binder.

Embodiments of the invention will now be described by way of example only with reference to the accompanying drawings in which:—

Figure 1:
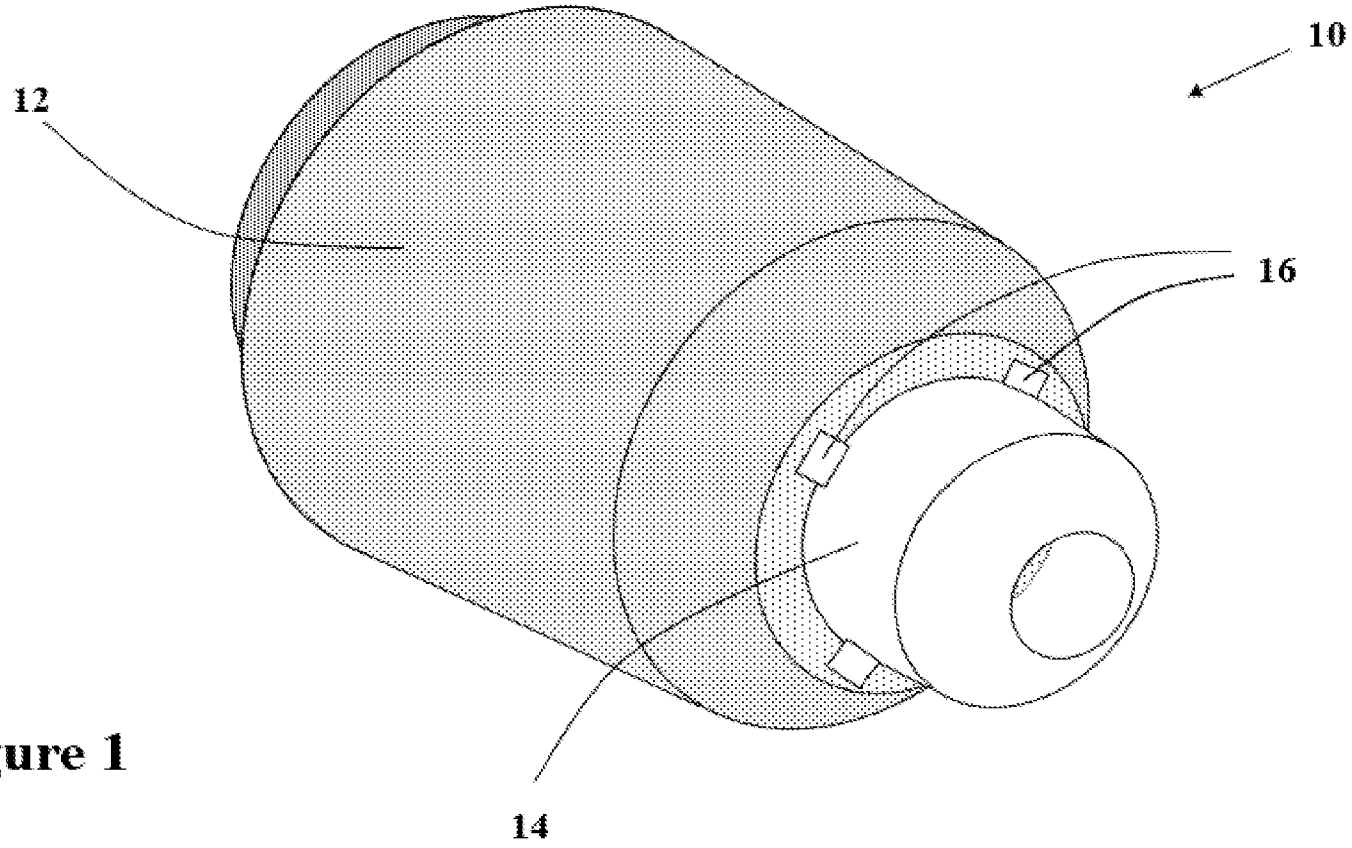
FIG. 1 is a perspective drawing of a feeder system in accordance with an embodiment of the invention.

FIG. 1 shows a feeder system 10 comprising a feeder sleeve 12 mounted on a tubular body 14. The feeder sleeve 12 is made from exothermic material (although insulating material could also be used) and the tubular body 14 is pressed from sheet steel. The tubular body 14 has a circular cross-section and comprises four integral wings 16 which support the feeder sleeve 12, and which are releasably attached by adhesive.

Figure 2B:
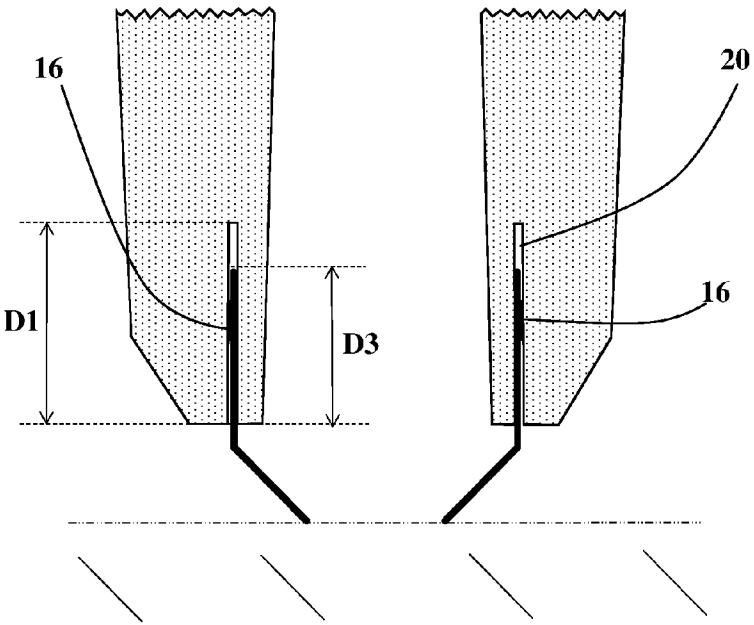
FIG. 2 shows a feeder system in accordance with an embodiment of the invention prior to ram-up (FIG. 2*a*) and after ram-up (FIG. 2*b*)
Figure 2A:
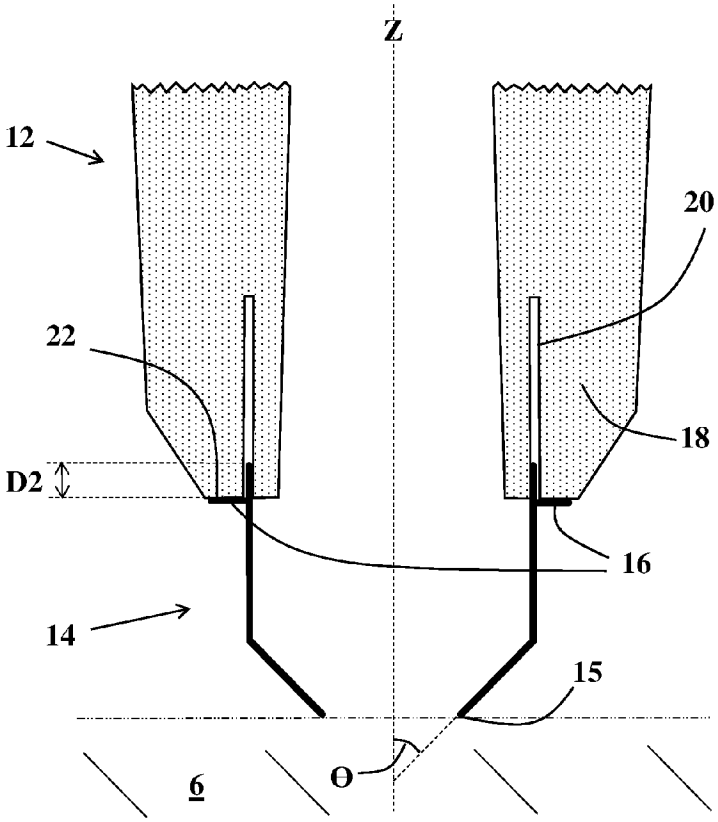

FIG. 2 is a cross-section of part of the feeder system of FIG. 1 on a moulding pattern plate 6 prior to ram-up (FIG. 2*a*) and after ram-up (FIG. 2*b*). A longitudinal axis Z passes through the feeder sleeve 12 and the tubular body 14. Referring to FIG. 2A a continuous sidewall 18 extends around the axis Z and encloses a cavity for a receiving liquid metal during casting. The tubular body 14 defines a bore along the axis Z which forms a passageway for liquid metal to travel from the feeder sleeve cavity to the casting.

The tubular body 14 tapers (narrows) away from feeder sleeve 12 to form a feeder neck 15. The angle θ of the tapered neck relative to the axis Z is approximately 45°. The tubular body 14 comprises wings (also known as tabs) 16. Each wing 16 is formed by making a pair of incisions into the edge of the tubular body 14 and folding the portion between the incisions outwards (approximately 90° to the bore axis Z). As such, the wings 16 are integrally formed outward projections. The wings 16 abut the base 22 of the sidewall 18.

The sidewall 18 has a circular groove 20 (of uniform width) which extends into the wall from its base 22. The groove 20 receives a portion of the tubular body 14. The location of the wings 16 determines how far the tubular body 14 projects into the groove 20, hence the wings are retaining means.

Referring to FIG. 2*b* there is shown the same feeder system after ram-up. The feeder sleeve 12 has been pushed onto the tubular body 14 deforming the wings 16 (the retaining means have been overcome). The wings 16 are flush with the rest of the tubular body 14 and no longer hold the tubular body 14 in place. Instead the tubular body 14 has been pushed further inside the groove 20. In this case the groove 20 is wide enough to accommodate the wings when flush against the rest of the tubular body 14.

The groove 20 has a depth D1. Prior to ram-up, the tubular body 14 projects into the groove 20 to a second depth D2, approximately 12% of the depth of the groove D1. After ram-up the tubular body projects into the groove 20 to a third depth D3, approximately 75% of the depth D1. Hence, ram-up causes relative movement of the feeder sleeve 12 and the tubular body 14 rather than breakage of the feeder sleeve 12.

Figure 3C:
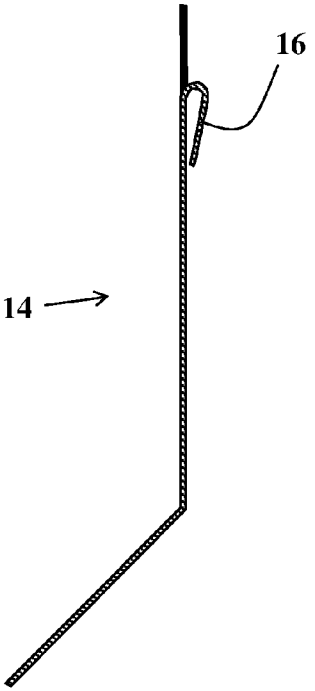
FIG. 3 is a schematic drawing of deformation of a retaining element in accordance with an embodiment of the invention.
Figure 3B:
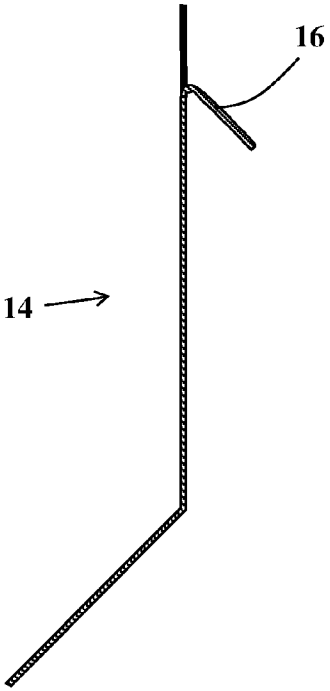
Figure 3A:
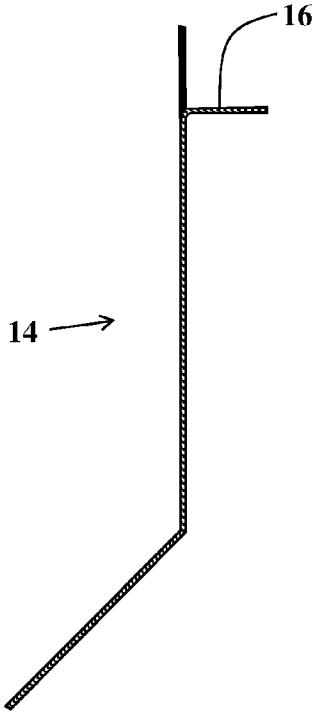

FIG. 3 is a schematic diagram of the deformation of a wing 16 as shown in FIGS. 1 and 2. FIG. 3*a* shows the wing 16 extending outward at an angle approximately 90° to the bore axis Z. FIG. 3*b* shows the wing 16 being pressed towards the rest of the tubular body 14. FIG. 3*c* shows the wing 16 folded back against the tubular body; in this position the tubular body 14 can move further into the groove 20.

Figure 4:
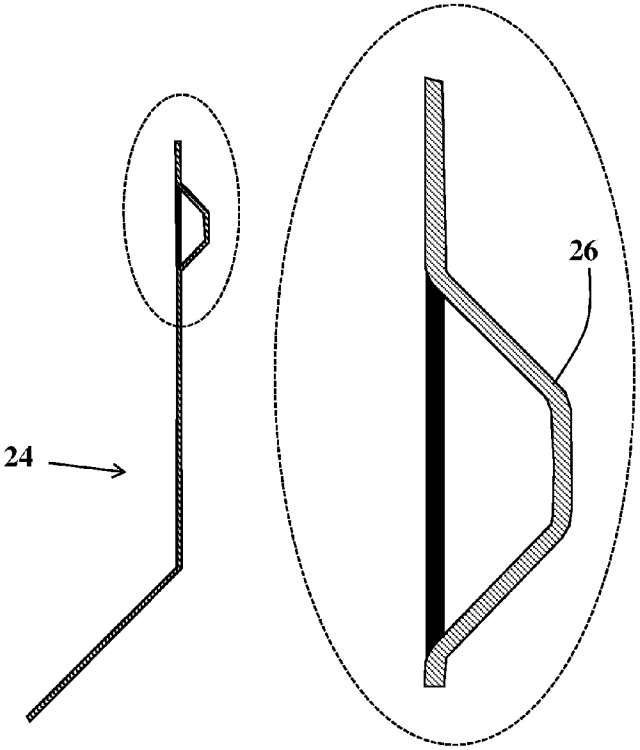

FIG. 4 shows part of a tubular body 24 for use in another embodiment of the present invention. The tubular body 24 has a number of integral retaining elements in the form of notches 26 (only one is shown). The notch 26 is formed by making a pair of parallel incisions in the tubular body 24, in a region away from the peripheral edge, and pushing the metal outwards so that it stretches. The tubular body 24 can be employed with the feeder sleeve 12 described previously. Prior to ram-up, the notch 26 projects outwards from the tubular body 24 within the groove 20 and grips the sidewall 18 to hold the tubular body 24 at a desired position (friction fit). The friction fit is overcome during ram-up, allowing the tubular body to move further into the groove 20, which has a uniform width. If a feeder sleeve having a tapered groove is employed, then during ram-up the notch 26 will be pressed inwards by the feeder sleeve to allow the tubular body 24 to move further into the groove and be held at the new position i.e. the retaining element will be deformed.

Figure 5:
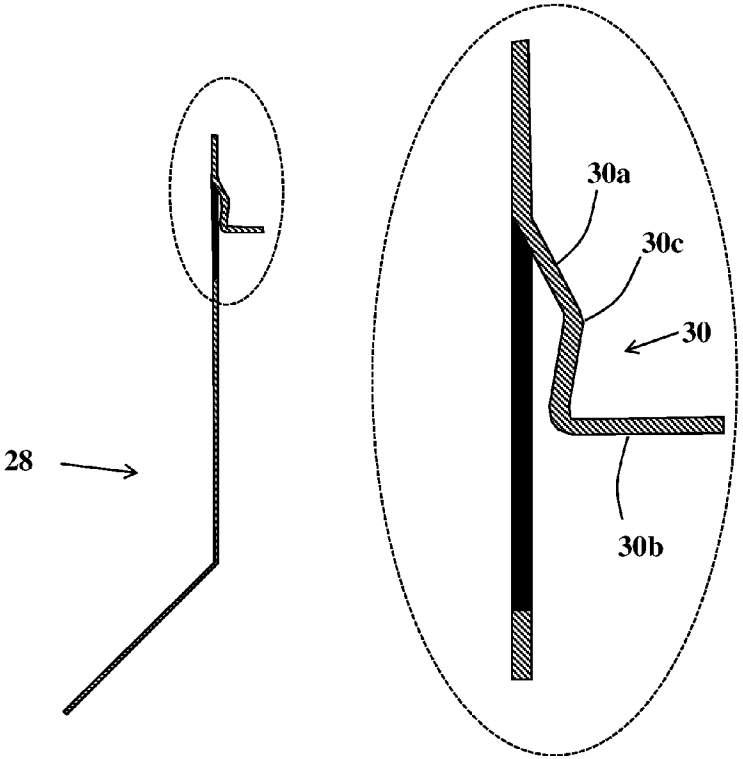
FIG. 4 and FIG. 5 show tubular bodies for use in a feeder system in accordance with embodiments of the invention.

FIG. 5 shows part of a tubular body 28 for use in another embodiment of the present invention. The tubular body 28 has integral retaining elements in the form of shaped notched wings 30 (only one is shown). The wing 26 is formed by cutting a tab from the tubular body, in a region away from the peripheral edge. The tab is pushed outwards and shaped as illustrated i.e. the upper part 30*a* of the wing extending generally downwardly and is crimped into a shall "v-shape". The lower part 30*b* of the wing is bent outwardly at approximately 90° to the bore axis. The tubular body 28 may be employed with the feeder sleeve 12 described previously; the upper part of the notched wing 30*a* will be located within the groove 20 with the point of the V 30*c* griping the inner surface of the sidewall 18 and the lower part 30*b* will be in contact with the base 22 to support the feeder sleeve 12. The winged notch 30 abuts the feeder sleeve 12 and therefore holds the tubular body 28 in a desired position before ram-up. During ram-up the upper part 30*a* will be pressed inwards and the lower part 30*b* will be folded down against the rest of the tubular body 28, to allow the tubular body 28 to move further into the groove 20.

Figure 6:
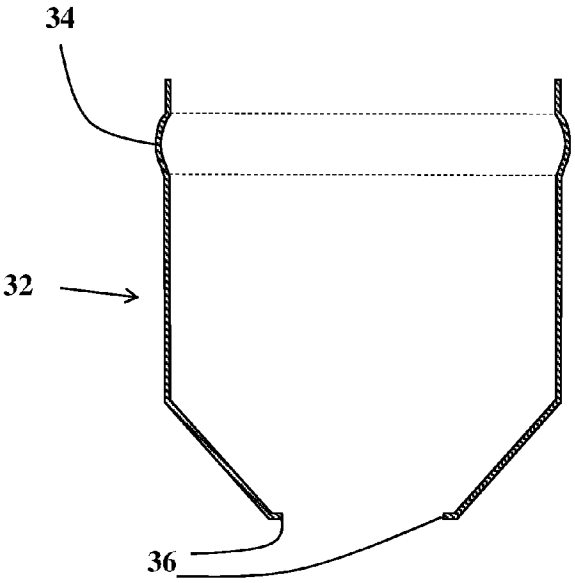
FIG. 6 shows a tubular body for use in a further embodiment of the invention.

FIG. 6 shows a tubular body 32 in accordance with a further embodiment of the invention. An integral rib 34 encircles the tubular body and is formed by pushing and stretching the metal outwards. The tubular body 32 has an inwardly directed annular lip or flange 36 at its base that sits on the surface of the mould pattern 6 in use, and produces a notch in the resulting metal feeder neck to facilitate its removal (knock off).

Figure 7:
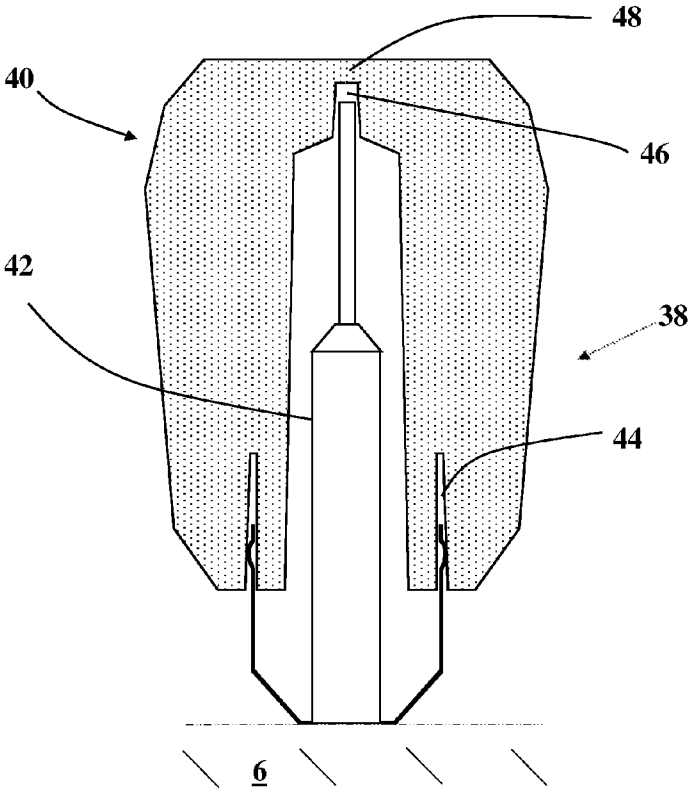
FIG. 7 shows a feeder system incorporating the tubular body of FIG. 6.

FIG. 7 is a feeder system 38 comprising the tubular body 32 of FIG. 6 and a feeder sleeve 40. The feeder system 38 is situated on a pattern plate 6 and moulding pin 42 prior to ram up. The sleeve 40 has a groove 44 that narrows from a maximum width at the base of the sleeve. The tubular body 32 is inserted in the sleeve 40 and the rib 30 grips and holds the tubular body 32 in place against the sides of the groove 44. On ram up, when pressure is applied the sleeve 40 moves downwards and the rib 30 is compressed allowing the tubular body 32 to move further into the narrowing groove 44. i.e. the integral rib 30 is deformed. The top of the moulding pin 42 is located in a complementary recess 46 in the roof 48 of the sleeve 40, and on ram up, as the sleeve moves downwards, the top of the moulding pin 42 pierces the thin section at the top of the roof 48. If desired a collar could be fitted in the recess 46 to avoid the risk of fragments of sleeve breaking off when the pin 42 punctures the roof 48. Alternatively a narrow aperture could extend through the roof 48 in place of the recess 46 and thereby accommodate the support pin 42. In this case the aperture would have a diameter corresponding to approximately 15% of the maximum diameter of the feeder sleeve cavity.

It will be understood that the tubular body 32 of FIG. 6 could be employed with a feeder sleeve having a groove of uniform width, instead of the tapered groove 44. If the tubular body 32 were employed with the feeder sleeve 12 having the uniform groove 20, no deformation would occur on ram-up. The rib 30 would grip and hold the tubular body in place against the sides of the groove 20 (friction fit) at the second depth. On ram up, when pressure is applied the sleeve 12 moves downwards and the friction is overcome allowing the tubular body to move further into the groove 20.

Figure 8B:
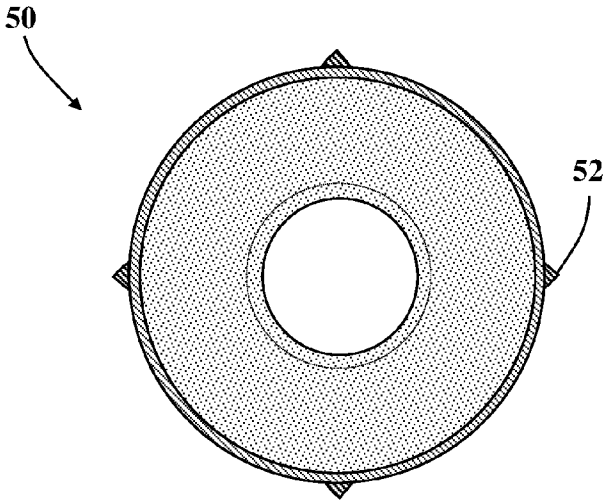
FIG. 8 shows a tubular body having fins for use in an embodiment of the invention.
Figure 8A:
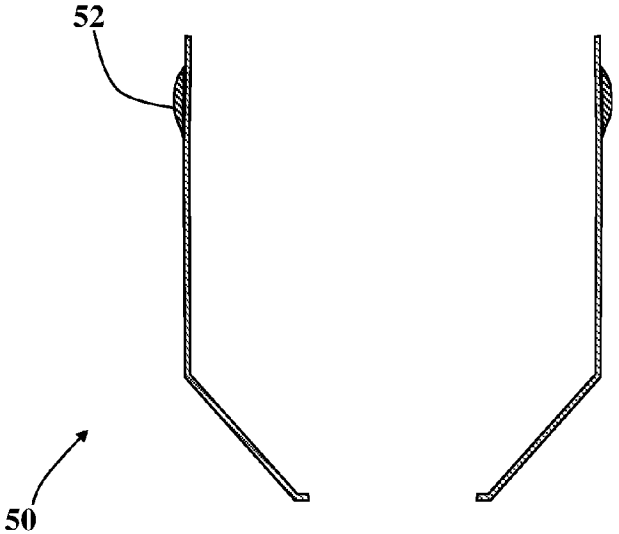

FIG. 8*a* is a section through a tubular body 50 that is pressed from sheet steel for use with a feeder sleeve. FIG. 8*b* is a lateral cross-section of the tubular body 50 and shows that the body has a circular cross-section and comprises four integral fins 52. In use the fins 52 hold the tubular body 50 in place within a groove in a feeder sleeve (friction fit). The tubular body 50 can be employed with a feeder sleeve having a groove of uniform width (e.g. the feeder sleeve 12) or a tapered groove (e.g. the feeder sleeve 40). In both cases the friction fit between the fins 52 and the groove is overcome on ram-up, allowing the tubular body 50 to be pushed further into the groove. The fins 52 are made from pressed steel, which is harder than feeder sleeve material, and do not deform on ram-up.

Figure 9B:
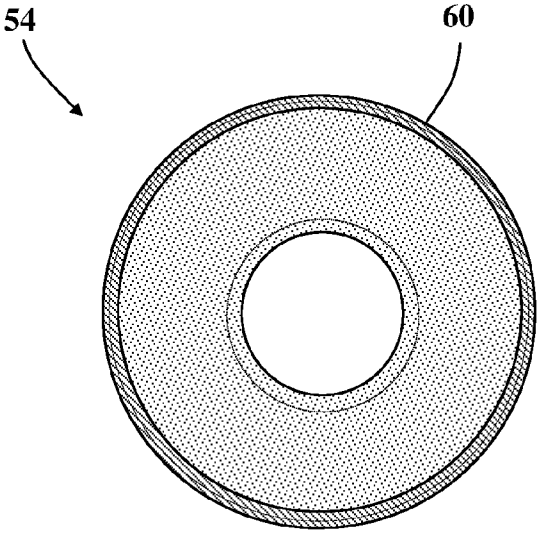
FIG. 9 shows a tubular body having an overlap for use in an embodiment of the invention.
Figure 9A:
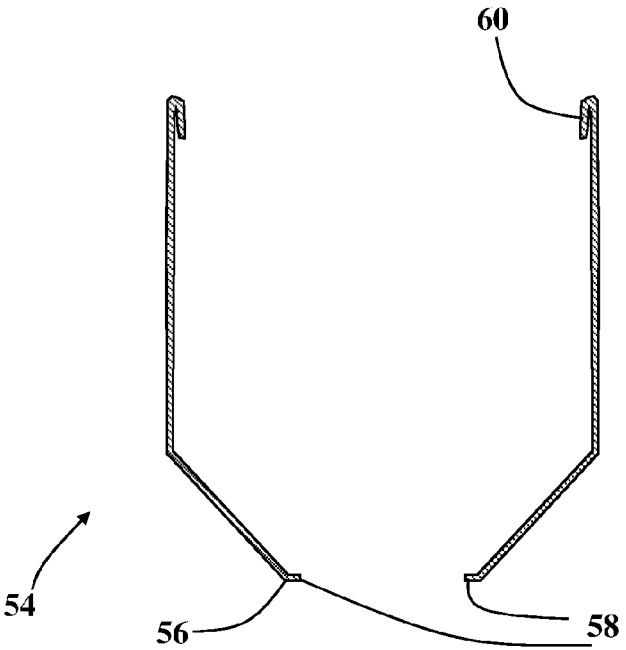

FIGS. 9*a* and 9*b* are sections through a tubular body 54 that is pressed from sheet steel for use with a feeder sleeve. Referring to FIG. 9*a*, one end of the tubular body 54 is tapered to form a feeder neck 56 with an inwardly directed lip or flange 58 and the opposite end is folded over to provide a portion of overlap 60. FIG. 9*b* shows that the tubular body 54 has a circular cross-section.

The tubular body 54 can be employed with a feeder sleeve having a groove of uniform width (e.g. the feeder sleeve 12) or a tapered groove (e.g. the feeder sleeve 40). In both cases a friction fit between the overlap 60 and the groove holds the body in place in the groove at the second depth. This friction fit is overcome on ram-up, allowing the tubular body 54 to be pushed further into the groove. The overlap 60 is reinforced and does not deform on ram-up. The overlap 48 may cause some abrasion of the feeder sleeve material, especially if employed with a tapered groove.

Figure 10:
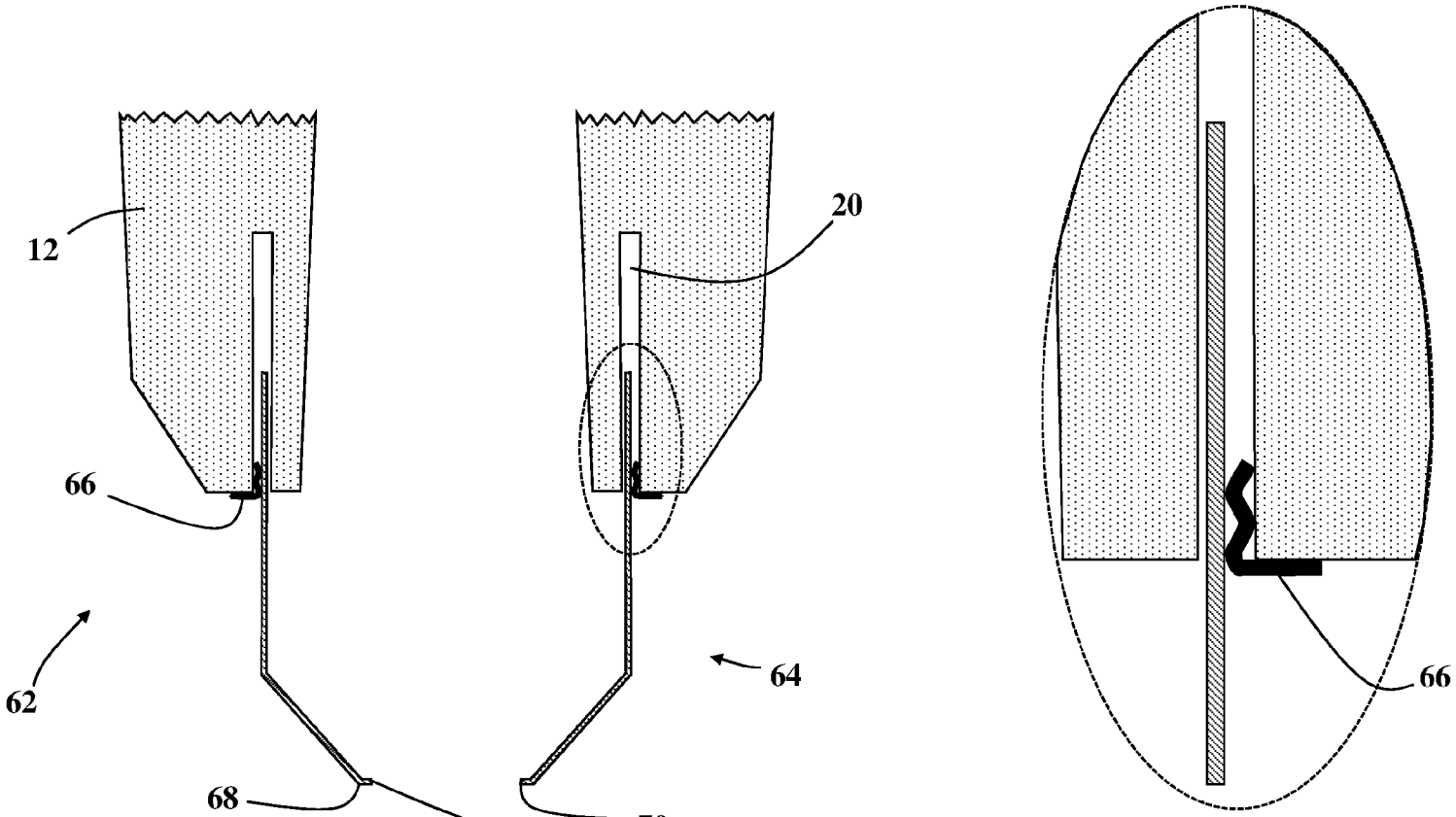
FIG. 10 shows a feeder system comprising biasing means in accordance with an embodiment of the invention.

FIG. 10 shows a feeder system 62 comprising a tubular body 64, a spring 66 and the feeder sleeve 12 (described previously), which has a groove 20 of uniform width. The tubular body 64 is pressed from sheet steel and narrows away from the feeder sleeve 12 to form a feeder neck 68 with an inwardly directed lip or flange 70. The spring 66 provides biasing means which hold the tubular body 64 within the groove 20 at the second depth. On ram-up the biasing means are overcome, allowing the tubular body 64 to be pushed further into the groove 20.

Figure 11:
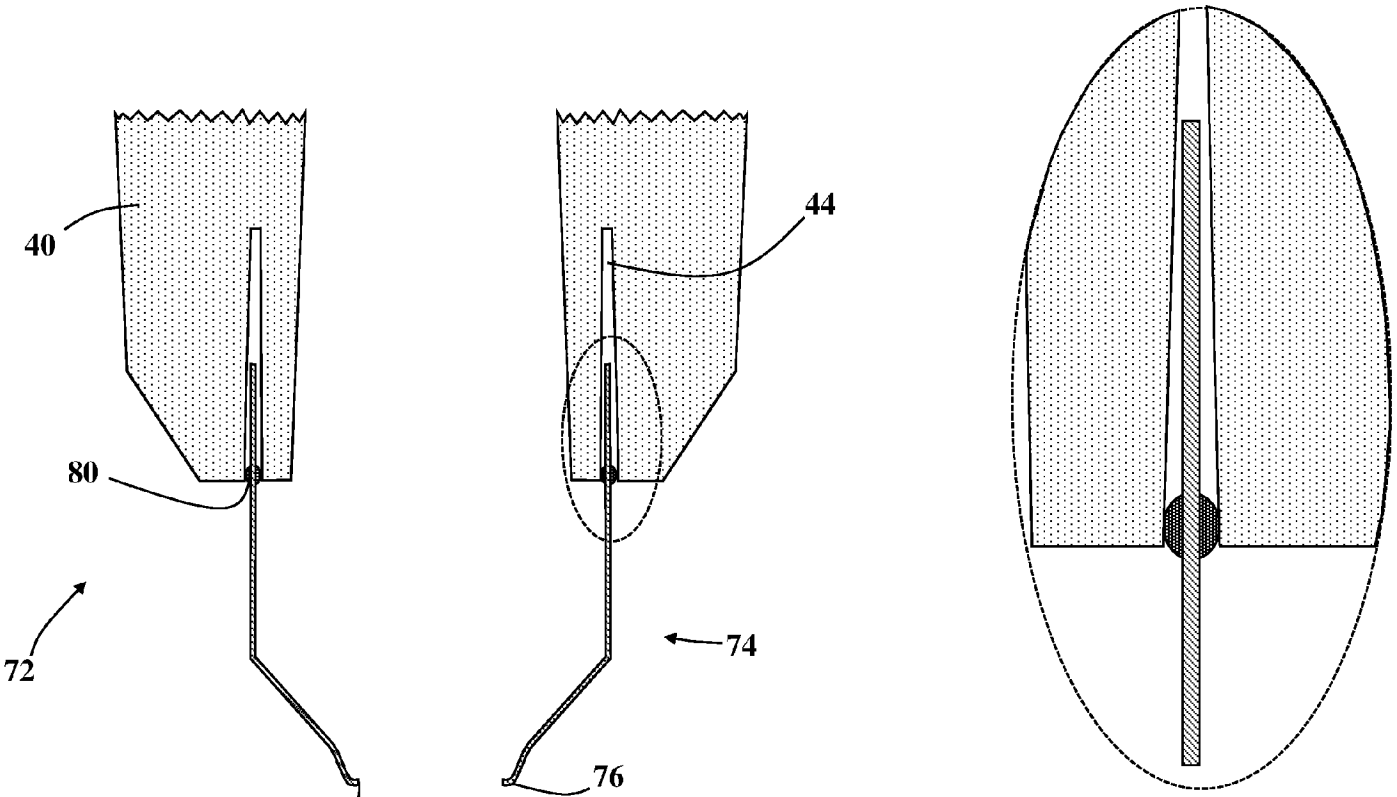
FIG. 11 shows a feeder system comprising a retaining element in accordance with an embodiment of the invention.

FIG. 11 shows a feeder system 72 comprising a tubular body 74 and the feeder sleeve 40 that has a tapered groove 44. The tubular body 74 tapers in two stages to form s a feeder neck 76 and has an inwardly directed lip or flange 78. The tubular body 74 is fixed in the groove 44 of the feeder sleeve 40 with glue (adhesive) 80*h*. The glue 80 breaks away from the tubular body 74 and/or the feeder sleeve 40 on ram-up allowing the tubular body to move further into the groove.

The invention claimed is:

1. A feeder system for metal casting comprising a feeder sleeve mounted on a tubular body;

the feeder sleeve having a longitudinal axis and comprising a continuous sidewall that defines a cavity for receiving liquid metal during casting, the sidewall extending around the longitudinal axis and having a base adjacent the tubular body;

the tubular body defining an open bore therethrough for connecting the cavity to the casting, wherein a groove extends into the sidewall from the base to a first depth and the tubular body projects into the groove to a second depth and is held in position by retaining means, the second depth being less than the first depth so that upon application of a force in use the retaining means are overcome and the tubular body is pushed further into the groove.

2. The system of claim 1, wherein the retaining means comprise a retaining element or retaining elements which releasably hold the tubular body in position at the second depth.

3. The system of claim 1, wherein the retaining means comprise the tubular body having at least one integral retaining element.

4. The system of claim 3, wherein the at least one integral retaining element is a projection from the tubular body.

5. The system of claim 4, wherein the projection is an outward projection.

6. The system of claim 4, wherein the projection is a wing, notch or rib.

7. The system of claim 1, wherein the tubular body has a thickness of no more than 3 mm.

8. The system claim 1, wherein the tubular body is made from metal or plastics.

9. The system of claim 8 wherein the metal is steel with a carbon content of less than 0.05% by weight.

10. The system of claim 1, wherein the first depth is at least 20 mm.

11. The system claim 1, wherein the tubular body has a height measured along a bore axis and the first depth is from 20 to 80% of the height of the tubular body.

12. The system of claim 1, wherein the groove has a maximum width measured in a direction approximately perpendicular to a bore axis of no more than 10 mm.

13. The system of claim 1, wherein the second depth is no more than 50% of the first depth.

14. The system of claim 1, wherein the groove is located at least 5 mm from the feeder sleeve cavity.

15. A process for preparing a mould comprising placing the feeder system of claim 1 on a pattern;

surrounding the pattern with mould material;

compacting the mould material; and removing the pattern from the compacted mould material to form the mould;

wherein the compacting the mould material comprises applying pressure to the feeder system such that the retaining means are overcome and the tubular body is pushed further into the groove to a third depth.

16. The process of claim 15, wherein the retaining means are overcome such that the tubular body is pushed further into the groove to a third depth, the third depth being at least 50% of the first depth.

17. The process of claim 15, wherein compacting the mould material comprises applying a ram up pressure of at least 30 $N/cm^2$.

* * * * *